US005692717A

United States Patent [19]

Glaeser

[11] Patent Number: 5,692,717

[45] Date of Patent: Dec. 2, 1997

[54] BRACKET FOR FASTENING SHELVES OF VARIOUS THICKNESSES TO A WALL

[75] Inventor: Willi Glaeser, Baden, Switzerland

[73] Assignee: Glaeser AG, Baden, Switzerland

[21] Appl. No.: 524,957

[22] Filed: Sep. 8, 1995

[30] Foreign Application Priority Data

Sep. 9, 1994 [CH] Switzerland ..... 02 759/94

[51] Int. Cl.[6] ..... A47B 57/04

[52] U.S. Cl. ..... 248/250; 248/242; 108/152

[58] Field of Search ..... 248/250, 235, 248/247, 316.1; 108/192, 180, 106, 110

[56] References Cited

U.S. PATENT DOCUMENTS

| | | | |
|---|---|---|---|
| 3,437,214 | 4/1969 | Sainsbury | 245/247 |
| 3,606,229 | 9/1971 | Wall | 248/235 |
| 4,691,887 | 9/1987 | Bassinger | 248/250 |
| 4,709,892 | 12/1987 | Gurgai | 248/250 |
| 4,856,746 | 8/1989 | Wrobel et al. | 248/250 |
| 5,064,158 | 11/1991 | Brazier et al. | 248/250 |
| 5,360,192 | 11/1994 | Pittella | 248/250 |

*Primary Examiner*—Leslie A. Braun
*Assistant Examiner*—Kimberly Wood
*Attorney, Agent, or Firm*—Morgan, Lewis and Bockius LLP

[57] ABSTRACT

A bracket for fastening shelves of various thicknesses to a wall comprising a support surface, a clamp opposite the support surface for pressing the shelf against the support surface, a shelf engagement region located between the support surface and the clamp for receiving the shelf, and a cover for concealing the clamp.

18 Claims, 3 Drawing Sheets

BRACKET FOR FASTENING SHELVES OF VARIOUS THICKNESSES TO A WALL

BACKGROUND OF THE INVENTION

1. Field of the Invention

The present invention relates to wall racks or wall shelf units and, in particular, to a bracket for fastening shelves of varying thicknesses to a wall with at least two identical brackets being used to fasten a shelf.

2. Description of the Related Art

Numerous designs of brackets of the aforementioned type are known, the simplest being plain angle brackets which can be fixed to the wall. These brackets have projecting arms securing support shelves. The support shelves may be fastened to the projecting arms by means of screws or the like. Wall shelf units constructed with brackets of this kind nevertheless leave much to be desired, particularly with respect to their visual appearance, and are therefore used mainly in places where an attractive appearance is not of primary importance.

For use in living quarters, on the other hand, brackets having a quite attractive appearance (of narrow design or else in the form of longitudinal sections) are already known and are, above all, distinguished by the depth of the shelf. They project only a relatively short distance from the wall, in some cases less than 10% of the total shelf depth, and thus give the shelf a light appearance, almost as if it were hanging from the wall.

In such cases, it is essential for the shelf to be secured to the bracket to prevent against upward movement, since the shelf would otherwise fall forward due to the distance by which it projects from the wall. To control the considerable upwardly directed forces or torques occurring when a load acts on the shelf, simple screwing is usually not sufficient, particularly in the case of wooden shelves. Known brackets are therefore also designed to grip around the shelves from behind and thus apply a holding and clamping action not only under the shelf but also above the forwardly projecting parts.

A bracket of this kind, the height of which is approximately as great as its width, is suitable for variable shelf thicknesses and includes two pressure diecastings of aluminum between which the shelf is clamped, an upper U-shaped part which grips around the shelf from above and is screwed to the wall, and a lower part which is moveable relative to the upper part and has a support surface for the shelf. In order to obtain the clamping action on the shelf, the lower part can be screwed against the upper part by means of two screws which are screwed into threaded holes in the bottom leg of the upper part and pass through two respective aligned holes in the lower part.

Although the known bracket is of simple construction and is simple to use, it has the disadvantage of having a lower part that provides the support surface for a shelf that is variable in height. In an assembly of wall shelf units, the shelf support surface typically forms the fixed reference height. In addition, the known bracket also has the disadvantage in that the screw connection must be made from below.

SUMMARY OF TEE INVENTION

An object of the present invention is to provide a visually attractive bracket of the above-described type which, as compared to the depth of the shelf, projects only a short distance from the wall and is suitable for different shelf thicknesses. Another object of the present invention is to provide a bracket that is easy to manufacture and assemble and has adequate stability. Still another object of the present invention is to provide a bracket that is appropriate for shelves of different materials, including plastics, stone or glass.

To achieve these and other advantages and in accordance with the purpose of the invention, as embodied and broadly described, the invention provides for a bracket for fastening shelves of various thicknesses to a wall comprising a support surface, a clamp opposite the support surface for pressing the shelf against the support surface, a shelf engagement region located between the support surface and the clamp for receiving the shelf, and a cover for concealing the clamp.

In another aspect, the invention provides for a clamp for pressing shelves of various thicknesses against a support surface comprises a fastening head, a vertical hole located in the fastening head, and a vertically adjustable clamp screw mounted in the vertical hole to press the shelves of varying thicknesses against the support surface.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate one embodiment of the invention and together with the written description serve to explain the principles of the invention. In the drawings.

DETAILED DESCRIPTION OF THE PREFERRED EMBODIMENTS

Reference will now be made in detail to the present preferred embodiment of the invention, an example of which is illustrated in the accompanying drawings.

Figure 1:
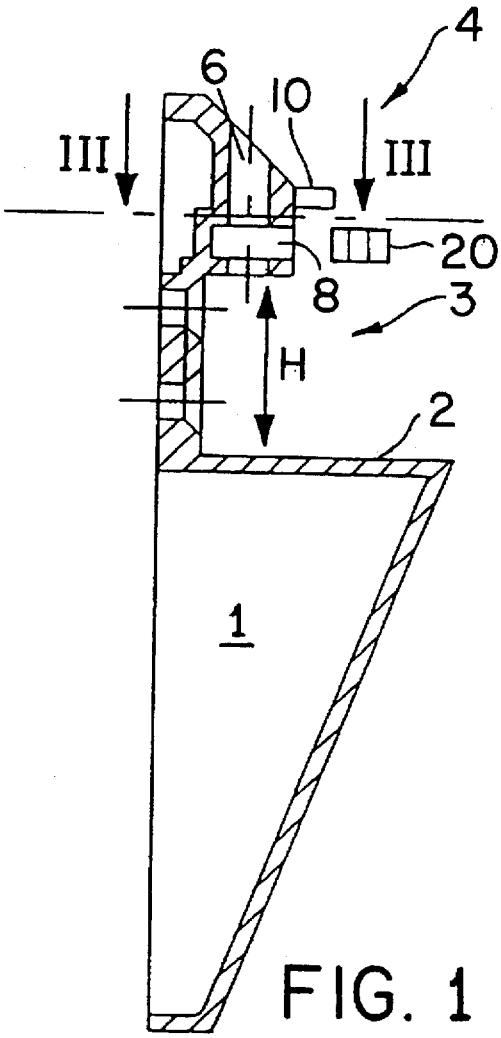
FIG. 1 is a support and clamp part in a longitudinal section on the line II—II in FIG. 2.
Figure 2:
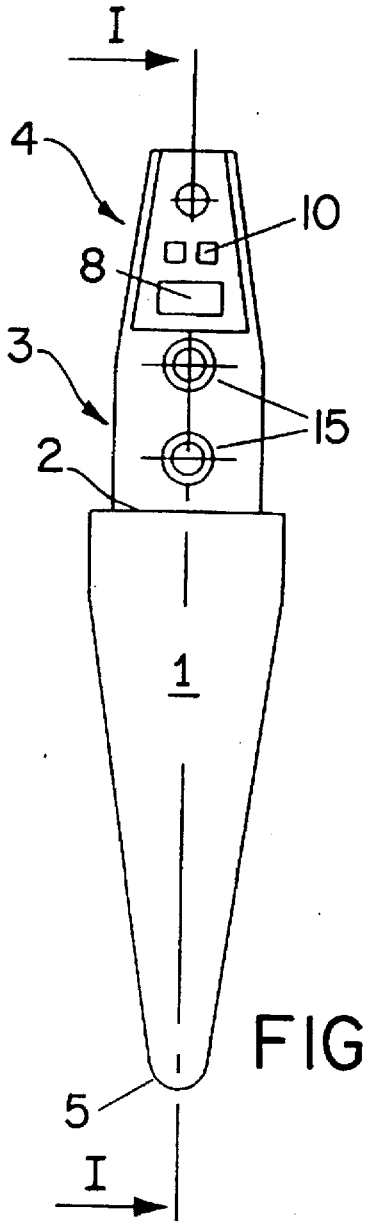
FIG. 2 is a front view of the support and clamp part shown in FIG. 1.
Figure 3:
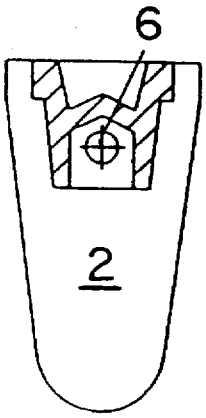
FIG. 3 is a cross-section through the support and clamp part of FIG. 1 on the line III—III in FIG. 1.

The support and clamp part 1 shown in FIG. 1 has a horizontal support surface 2 for a shelf (not shown), a shelf engagement region 3, and a fastening head 4. Under the support surface 2, the support and clamp part 1 is a hollow body which is open at the rear and, as can be seen in the sectional representation shown in FIG. 1, has in side view an approximately triangular shape. As shown in FIG. 2, the hollow body also tapers downwards with respect to its width, so that a rounded tip 5 is formed. The horizontal cross-sectional profile of the support surface 2 can be seen in FIG. 3.

Figure 4:
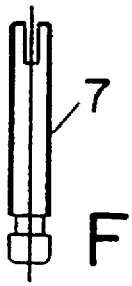
FIG. 4 is an elevation of a clamp screw.

In the shelf engagement region 3, two holes 15 for wall fastening screws are provided one above the other. In the fastening head 4, a vertical hole 6 is left as a vertical guide for a shelf clamp screw 7, which is illustrated in FIG. 4. In addition, the fastening head 4 has a recess 8 in which a nut 20 (see FIG. 1) fitting the clamp screw 7 can be non-rotatably received. Consequently, it is not necessary to provide a screw thread for the clamp screw 7 in the fastening head 4.

The clamp screw 7 does not have a widened head so that it can be screwed completely into the hole 6. The widened clamp foot 9 shown in FIG. 5 can be fastened at its foot end (not numbered). Finally, two guide bosses 10 are formed on the fastening head 4.

Figure 5:
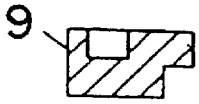
FIG. 5 is a clamp foot for the clamp screw of FIG. 4.
Figure 6:
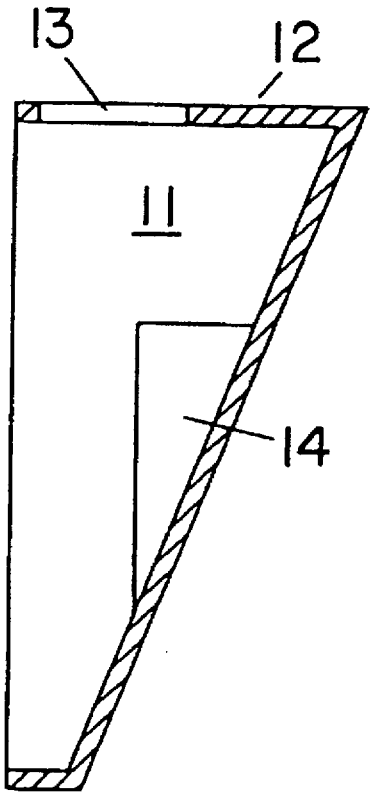
FIG. 6 is a cover part in longitudinal section on the line VI—VI in FIG. 7.
Figure 7:
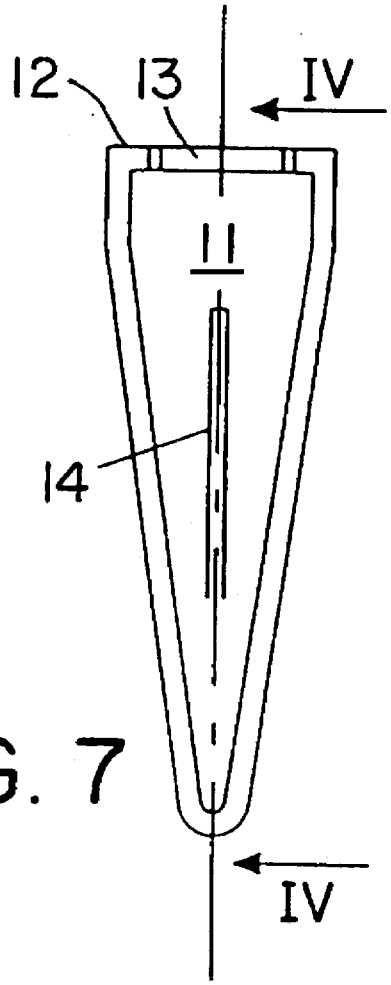
FIG. 7 is a rear view of the cover part of FIG. 6.
Figure 8:
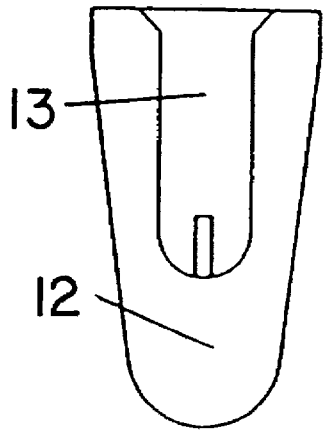
FIG. 8 is the underside of the cover part of FIG. 6.

The bracket according to the invention is completed by a cover part 11, which is shown in FIGS. 6 to 8. Like the lower portion of the support and clamp part 1, the cover part 11 is a hollow body open at the rear and has the same or similar external shape as the lower portion. The bracket has a recess 13, by means of which the cover part 11 can be engaged in the style of a shoe onto the widened clamp foot 9 as shown in FIG. 5. Finally, a narrow rib 14 is also formed in the interior of the cover part 11 to cooperate with the previously mentioned bosses 10 on the fastening head 4 of the support and clamp part 1.

Figure 9:
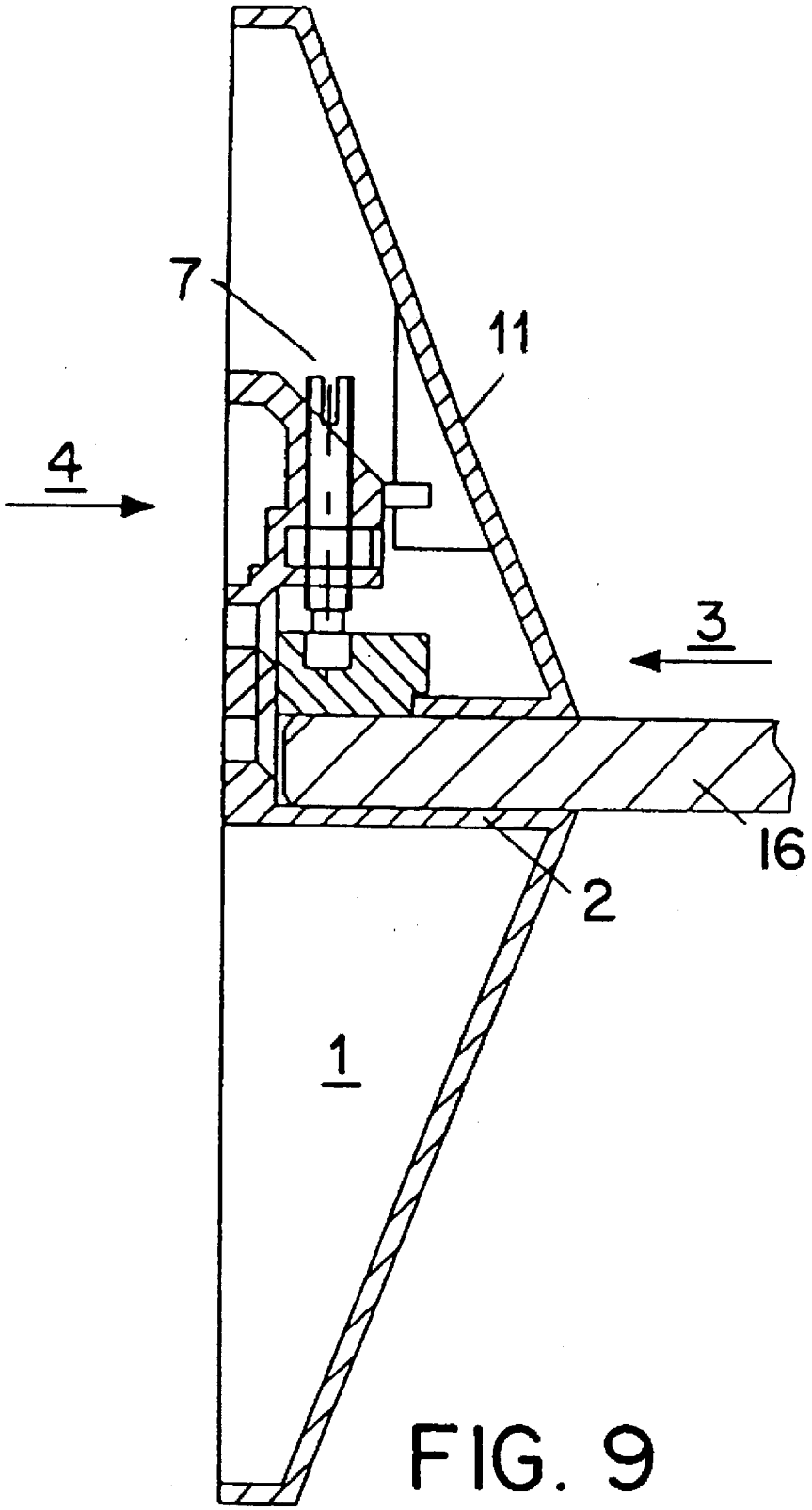
FIG. 9 is a sectional representation the bracket according to the invention in assembled form with the shelf clamped in place.

The wall shelf unit as described above is simple to assemble. Preferably, the clamp screw 7 is already preassembled by means of a nut 20 inserted into the recess 8 and is also provided with the clamp foot 9. The support and clamp part 1 can therefore be quickly attached to the wall with the aid of one or two fastening screws. As soon as another, identical support and clamp part has been installed at the same height and at a distance therefrom, a shelf can be inserted into the shelf engagement region 3 and fixed therein by tightening the clamp screw 7. Shelves of different thicknesses can obviously be used. It is then only necessary to attach the cover part 11, by means of its base part 12 in the form of a shoe, onto the clamp foot 9 of the clamp screw 7 to complete the visual appearance. Through the fastening of the cover part 11 on the clamp foot 9 of the clamp screw 7, the vertical height of the cover part is dictated by the position of the clamp screw 7. Despite different shelf thicknesses, the cover part 11 always makes a good fit with the upper face of the shelf. The cover part 11 is simply supported on the fastening head 4 by use of the aforementioned rib 14, which engages slidingly between the likewise aforementioned guide bosses 10. The bracket according to the invention, completely assembled and with a shelf 16 clamped in position, is shown in FIG. 9.

In the assembled state, the bracket according to the invention, excluding the shelf engagement region 3, has approximately the shape of a slender boat body. Both the support and clamp part 1 and the cover part 11 are preferably injection moldings, preferably of a plastics material, such as polyamide.

The support and clamp part 1 and also the cover part 11 preferably project from the wall approximately twice the maximum height H of the shelf engagement region 3. The overall height of the bracket, determined by the support and clamp part 1 together with the cover part 11, preferably is approximately equal to eight times the maximum height of the shelf engagement region 3. The maximum width of the support and clamp part 1 and also of the cover part 11 preferably corresponds approximately to the maximum height H of the shelf engagement region 3.

It will be apparent to those skilled in the art that various modifications and variations can be made in the bracket of the present invention without departing from the spirit or scope of the invention. Thus, it is intended that the present invention cover the modifications and variations of this invention provided they come within the scope of the appended claims and their equivalents.

What is claimed is:

1. A bracket for fastening shelves of various thicknesses to a wall comprising:

a support member having a lower support surface, the support member having a first exterior shape;

an adjustable upper clamp secured to the support member for pressing the shelf against the support surface;

a shelf engagement region located between the support surface and the clamp for receiving the shelf; and a cover secured to the clamp having a second exterior shape and concealing the clamp, wherein the first and second exterior shapes are substantially identical.

2. The bracket of claim 1, wherein the support surface and the cover are formed from hollow bodies.

3. The bracket of claim 1, wherein the support surface and the cover are formed from injection moldings of a plastic polyamide material.

4. The bracket of claim 1, wherein the bracket has the shape of a boat body.

5. The bracket of claim i, wherein a maximum height of the bracket corresponds approximately to eight times a height of the shelf engagement region.

6. The bracket of claim 1, wherein a maximum width of the bracket corresponds approximately to a height of the shelf engagement region.

7. The bracket of claim 1, wherein the bracket is substantially symmetrical about the shelf engagement region.

8. The bracket of claim 1, wherein at least one fastening hole is provided in the shelf engagement region.

9. The bracket of claim 1, wherein the clamp includes a clamp screw with a clamp foot.

10. The bracket of claim 9, wherein the cover includes a push-on shoe corresponding to the clamp foot.

11. The bracket of claim 9, wherein a height of the shelf engagement region is less than twice a width of the clamp foot.

12. The bracket of claim 1, wherein the support surface and the clamp project from the wall to a distance less than twice a height of the shelf engagement region.

13. The bracket of claim 1, further comprising a fastening head for supporting the clamp.

14. The bracket of claim 13, wherein the fastening head includes at least two guide bosses and the cover includes a vertical guide rib, and wherein the guide bosses and the vertical guide rib are in a cooperative relationship for securing the cover to the fastening head.

15. The bracket of claim 1, wherein a vertical position of the cover is determined by the position of the clamp.

16. A bracket for fastening shelves of various thicknesses to a wall comprising:

a first member having a support surface;

a clamp including an adjustable upper clamp screw and a clamp foot opposite the support surface for pressing the shelf against the support surface;

a shelf engagement region located between the support surface and the clamp for receiving the shelf; and a second member including a cover for concealing the clamp and having a location, the cover being mechanically connected to the clamp foot, whereby the location of the cover is determined by the clamp screw and clamp foot.

17. The bracket of claim 16, further comprising threading means for threading the clamp screw in a vertical hole.

18. The bracket of claim 17, wherein the threading means includes a nut non-rotatably received in a corresponding recess of first member.

* * * * *